United States Patent [19]

Miller

[11] 4,428,579

[45] Jan. 31, 1984

[54] DICE AGITATION AND CASTING APPARATUS

[75] Inventor: Albert J. Miller, Campbell, Calif.

[73] Assignee: Atlas Electronics International, Inc., Los Gatos, Calif.

[21] Appl. No.: 367,435

[22] Filed: Apr. 12, 1982

[51] Int. Cl.[3] ..... A63F 9/04

[52] U.S. Cl. ..... 273/145 CA

[58] Field of Search ..... 273/145, 144 B

[56] References Cited

U.S. PATENT DOCUMENTS

| | | | |
|---|---|---|---|
| D. 151,562 | 10/1948 | Southwell | 273/145 C X |
| 1,781,983 | 11/1930 | Koch | 273/145 C |
| 3,124,359 | 3/1964 | Bottini | 273/145 D |
| 3,269,732 | 8/1966 | MacPherson | 273/145 A |
| 3,360,267 | 12/1967 | Johnson | 273/145 C |
| 3,489,414 | 1/1970 | Smith | 273/145 R |
| 4,188,034 | 2/1980 | Dempsey et al. | 273/145 C |

FOREIGN PATENT DOCUMENTS

| | | | |
|---|---|---|---|
| 453,454 | 12/1927 | Fed. Rep. of Germany | 273/145 C |
| 665499 | 5/1929 | France | 273/145 C |

*Primary Examiner*—Paul E. Shapiro

*Attorney, Agent, or Firm*—Harris Zimmerman; Howard Cohen

[57] ABSTRACT

A device for agitating, casting, and displaying dice includes a base housing having a pair of arms extending upwardly from opposed sides thereof. A dice housing is rotatably supported by the arms, and includes a window for viewing the dice within the housing. One of the support arms includes a lamp disposed to illuminate the interior of the dice housing, the base housing including a battery and a switch for selectively illuminating the lamp. The interior of the dice housing is lined with resilient baffled inserts extending at oblique angles to enhance the agitation of the dice as the dice housing is rotated.

5 Claims, 5 Drawing Figures

DICE AGITATION AND CASTING APPARATUS

BACKGROUND OF THE INVENTION

The casting of dice is an ancient sport. Over the centuries, both the dice and the methods of using them have undergone constant change. Dice, for instance, have evolved from crudely marked bits of rock and bone to the precisely dimensioned and manufactured cubes of modern time. Originally, it is presumed that dice were agitated in the cupped hand, as is most commonly done in the present day game known as craps. With time, different and more sophisticated methods of dice agitation were developed. Random distribution of the numerical values read from the cast dice was a principal objective.

One of the early devices employed to agitate and cast dice was the dice cup, which is still in use today. In using the dice cup, the player inserts the dice in the cup, shakes the cup, and casts the dice. In this manner, the dice are agitated and a random distribution of their values is obtained when they are cast. One advantage of the dice cup is that large numbers of dice may be cast conveniently. A further advantage of the dice cup is that it substantially eliminates control of the dice by a skilled manipulator. As is generally the case with hand-agitated dice, dice from a dice cup are cast onto a relatively smooth surface such as a table or floor. After casting, the dice must be manually reinserted into the dice cuup for the next cast.

The dice cup does not, however, solve all the problems inherent in games in which the result depends upon random number distribution. Because of the necessary manual handling of the dice, one or more dice may be surreptitiously replaced with unauthorized substitutes to alter the statistical distribution of the numerical values obtained in play.

Partly as a solution to the problems which arise when dice are manually handled, devices have been developed in the prior art for playing dice games without recourse to manual casting of the dice. The most basic of these prior art devices is an hour-glass shaped cage having flat ends. The cage is mounted vertically and pivots about a horizontal axis through its medial portion. When the cage is rotated about its axis, the upper and lower portions are inverted and the dice fall from the upper to lower portions and undergo agitation. Because no manual handling is required, the possibility of replacement of the dice is obviated. A problem associated with the cage device described above is that the size of the cage must be substantial in order to provide a sufficient height to agitate the dice adequately. Furthermore, the long cage assembly necessarily traverses a large arc during rotation and thus requires substantial free space in its vicinity.

A further problem associated with such prior art devices is that the dice game participants may not get a clear view of the dice within the tumbling apparatus, due to the structure of the cage itself and possible low ambient illumination.

SUMMARY OF THE PRESENT INVENTION

The present invention generally comprises a device for agitating, casting, and displaying dice. It includes a base housing having a pair of arms extending upwardly from opposed sides thereof. A dice housing is rotatably supported by the arms, and includes a window for viewing the dice within the housing. One of the support arms includes a lamp disposed to illuminate the interior of the dice housing, the base housing including batteries and a switch for selectively illuminating the lamp. The interior of the dice housing is lined with resilient baffled inserts extending at oblique angles to enhance the agitation of the dice as the dice housing is rotated.

A BRIEF DESCRIPTION OF THE DRAWING

DESCRIPTION OF THE PREFERRED EMBODIMENT

Figure 1:
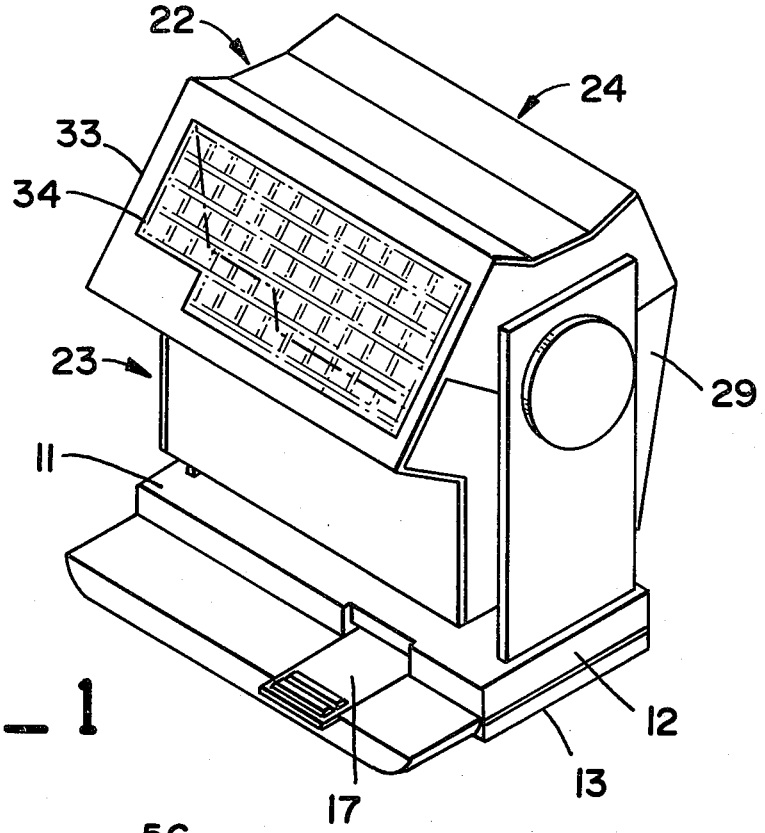
FIG. 1 is a perspective view of the dice agitation and display apparatus of the present invention.
Figure 2:
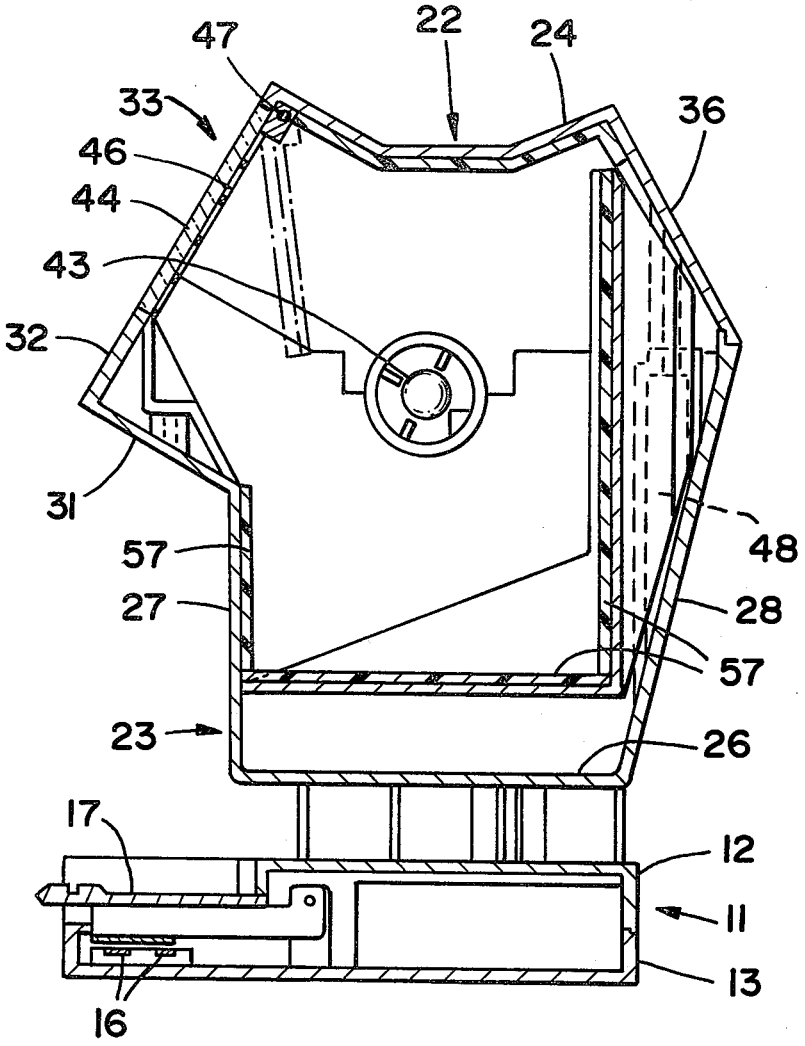
FIG. 2 is a cross-sectional side elevation of the dice agitation and display apparatus of the present invention.
Figure 3:
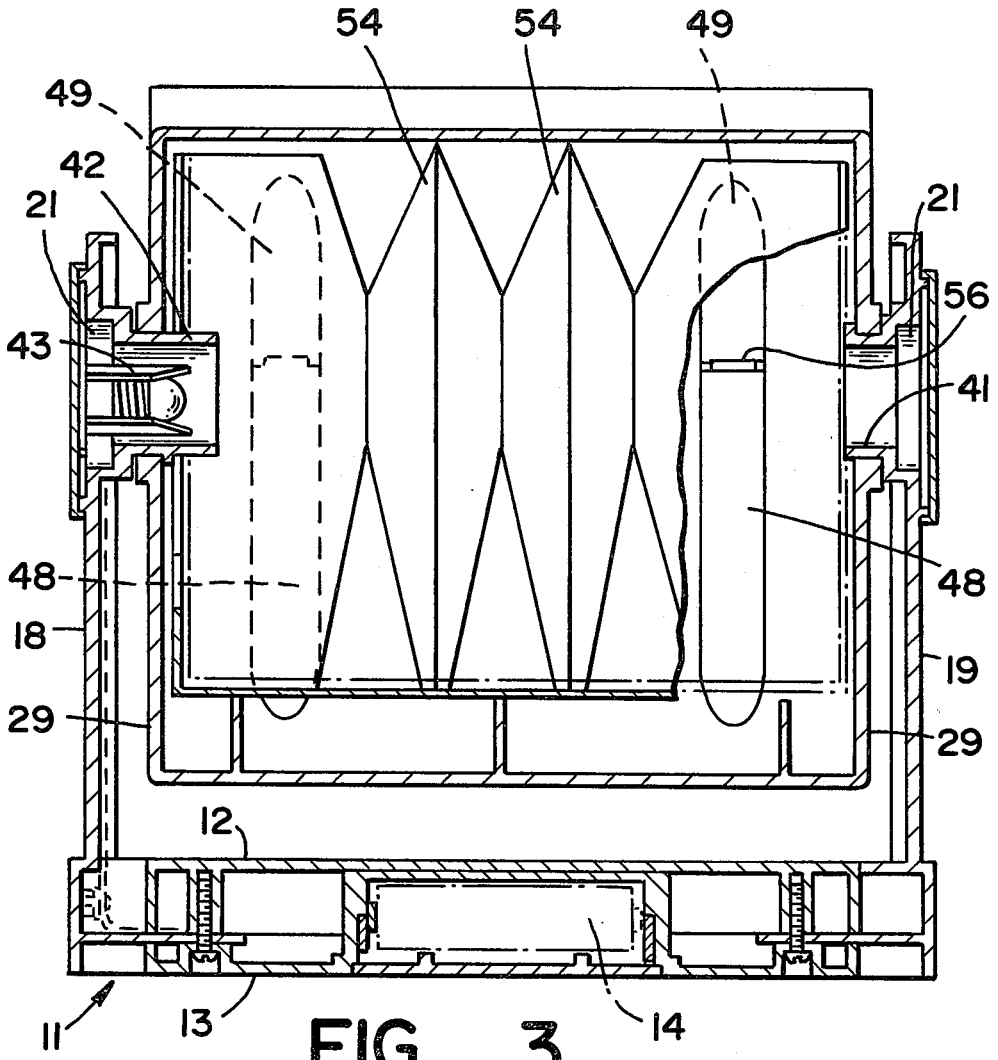
FIG. 3 is a front cross-sectional elevation of the dice agitation and display apparatus of the present invention.

The present invention generally comprises a device for agitating, casting, and displaying dice for games which require dice, as are known in the prior art. With reference to FIGS. 1–3, the invention includes a base assembly 11 which is generally rectangular in configuration and which is formed of an upper base housing 12 and a lower base housing 13. Supported within the base 11 is a battery 14 of electrical cells and a pair of electrical switch contacts 16 connected thereto. A push button 17 is disposed above the contact 16 and is adapted to be manually depressed to connect the contacts 16 in electrically conducting fashion.

Extending upwardly from the base assembly 11 are a pair of support arms 18 and 19, the arms 18 and 19 being disposed at opposed ends of the base assembly 11. Each of the arms 18 and 19 are provided with generally circular apertures 21 extending through the upper end portions thereof.

The invention also includes a dice housing 22 which is rotatably supported in the circular apertures of the support arms 18 and 19. The dice housing 22 includes a lower housing member 23 and an upper housing member 24 assembled thereto. The lower housing 23 includes a bottom wall 26 and a front wall 27 extending orthogonally and upwardly therefrom. A rear wall 28 extends obliquely upwardly from the rear edge of the bottom wall 26. A soffet panel 31 extends obliquely outwardly from the upper edge of the front panel 27. A window panel 32 is joined in orthogonal fashion to the distal edge of the panel 31. A pair of side panels 29 extend between the laterally opposed edges of the walls 26–28, 31, and 32 to define a coffer within the lower housing 23.

The upper housing member 24 also includes a window panel 33 which is generally co-extensive with the window panel 32 when the housing is assembled. A window opening 34 is disposed in the panels 32 and 33, for purposes which will be described in the following disclosure. The upper housing portion 24 also includes a rear wall 36 which extends obliquely downwardly to join the upper edge of the rear wall 28 of the lower housing. The housing members 24 and 23 also include arcuate cut-outs in the side walls thereof, the cut-outs combining to define circular openings in the assembled dice housing. These circular cut-outs are disposed in axial, confronting fashion with the holes 21 in the support arms. Disposed concentrically with respect to each of the holes 21 is a cylindrical boss 41 and 42, as shown in FIG. 3. Both of the cylindrical bosses 41 ad 42 extend inwardly into the circular cut-outs in the dice housing to support the housing in freely rotating fashion. In addition, the cylindrical boss 42 supports an electric lamp assembly 43 which is disposed to direct the light therefrom into the enclosure of the dice housing. The lamp assembly 43 is connected to the switch 17 by wires extending thereto.

The dice housing also includes a window 44 which is assembled directly to a screen 46. The window and screen are dimensioned to fit within the window cut-out 34. The screen 46 is hingeably secured to the upper housing 24 by laterally opposed ears 47. As shown in FIG. 2, in phantom line, the window-screen assembly may be pivotted inwardly to gain access to the interior of the housing 22. A pair of torsional springs are secured about the ears 47 to bias the window-screen assembly toward the closed position.

The rear walls 28 and 36 of the housing portions 23 and 24 are provided with a pair of cylindrical recesses 48 and 49 extending upwardly therein and disposed in mutual alignment. The cylindrical recesses provide added rigidity to the rear walls, and also provide a means of joining the upper and lower housing portions by a pair of screws extending therebetween.

Figure 4:
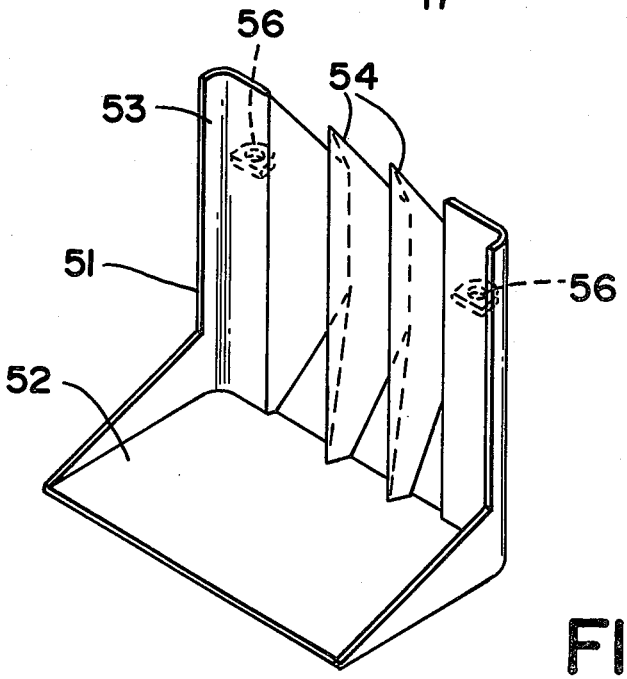
FIG. 4 is a perspective view of the tumbling insert of the apparatus of the present invention.
Figure 5:
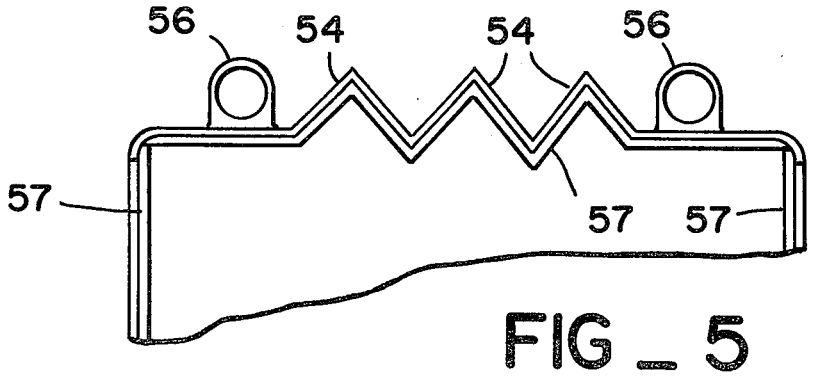
FIG. 5 is an enlarged top view of the tumbling insert assembly of the apparatus of the present invention.

Received within the dice housing is a tumbling insert 51, as shown in FIG. 4. The tumbling insert includes a generally planar bottom panel 52, and a rear panel 53 extending upwardly from the rear edge thereof. The panel 53 is provided with a plurality of vertically extending baffles 54 which are defined by upwardly extending planar surfaces which diverge from common vertices at oblique angles, as shown in FIGS. 4–6. The tumbling insert 51 also includes a pair of mounting lugs 56 which are interposed between the members 48 and 49 to join the tumbling insert 51 to the dice housing assembly.

All of the base housing and dice housing components may be formed of a cast plastic material, such as ABS plastic. However, the window 44 may be formed of clear acrylic plastic, while the screen 46 may be formed of a softer polyethylene plastic. It may be appreciated that the screen 46 protects the window 44 from damage caused by impact of the dice, while still affording a clear view of dice supported within the housing.

The invention also includes a resilient foam lining 57 which is supported at the back and bottom of the housing by the tumbling insert 51. The lining 57 is adhered directly to the tumbling insert, and to the other walls of the dice housing 22. The soft foam material cushions the impact of the dice on the dice housing, reducing wear on the dice and, more importantly, serving as an acoustical dampening agent to eliminate much of the noise associated with dice games. It may be appreciated that the baffles 54 provide many oblique surfaces on which the dice may impinge. The oblique orientation of the surfaces serves to increase the agitation of the dice as the housing 22 is rotated.

To employ the crap box of the present invention, the window-screen assembly may be urged inwardly manually to introduce a set of dice into the dice housing. Thereafter, the housing may be rotated manually by imparting a rotational motion to the top of the housing, or indeed, any other accessible surface of the housing. The dice housing will rotate freely about the cylindrical bosses 41 and 42, causing the dice therein to impact against the cushioned surfaces and baffles, and become agitated thereby. Due to the fact that the center of gravity of the dice housing is disposed well below the cylindrical bosses 41 and 42, the housing will always come to rest rather quickly in the disposition shown in FIGS. 1 and 2. This completes the dice agitating and casting procedure. To read the results of the dice cast, individuals may view the dice resting on the cushioned floor 52 by looking through the window of the dice housing. If there is insufficient illumination, the button 17 may be depressed to activate the lamp assembly 43 which illuminates the interior of the dice housing. The results of the dice casting may then be used to further whatever game of chance is being played.

I claim:

1. A device for agitating, casting, and displaying dice, including a base housing, a pair of arms extending upwardly from opposed sides of said base housing, a dice housing rotatably supported by said arms, said dice housing comprising a closed chamber, a window in said dice housing for viewing dice within said dice housing, said window being hingeably secured to said dice housing to permit access to said closed chamber, means for illuminating the interior of said dice housing, said arms including a pair of cylindrical bosses extending inwardly therefrom, said bosses engaging generally cylindrical holes in said dice housing in supporting and rotatable fashion, one of said pair of bosses including an electrical lamp assembly fixedly secured therein and disposed to illuminate the interior of said dice housing, a battery disposed in said base housing, and a pushbutton switch connected to said battery and said lamp.

2. The device of claim 1, further including a pair of wires connecting said pushbutton switch and said lamp assembly.

3. The device of claim 1, further including tumbling insert means disposed within said housing to increase the agitation of dice within said housing.

4. The device of claim 3, wherein said tumbling insert means includes a plurality of generally planar surfaces disposed in pairs, each pair extending obliquely from a common vertex.

5. The device of claim 1, further including resilient lining means disposed within said dice housing to cushion dice within said dice housing and provide acoustical dampening.

* * * * *